US011028974B1

(12) United States Patent
Lu et al.

(10) Patent No.: US 11,028,974 B1
(45) Date of Patent: Jun. 8, 2021

(54) LED TUBE WITH BUILT-IN DRIVING POWER MODULE

(71) Applicant: Xiamen PVTECH Co., Ltd., Fujian (CN)

(72) Inventors: Fuxing Lu, Fujian (CN); Rongtu Liu, Fujian (CN)

(73) Assignee: Xiamen PVTECH Co., Ltd., Fujian (CN)

( * ) Notice: Subject to any disclaimer, the term of this patent is extended or adjusted under 35 U.S.C. 154(b) by 0 days.

(21) Appl. No.: 16/857,186

(22) Filed: Apr. 24, 2020

(30) Foreign Application Priority Data

Dec. 25, 2019 (CN) ..... 201922366535.1

(51) Int. Cl.

| | |
|---|---|
| ***F21K 9/278*** | (2016.01) |
| ***F21V 23/06*** | (2006.01) |
| ***F21V 23/00*** | (2015.01) |
| ***H05B 45/357*** | (2020.01) |
| ***F21Y 115/10*** | (2016.01) |
| ***F21Y 103/10*** | (2016.01) |

(52) U.S. Cl.
CPC ..... *F21K 9/278* (2016.08); *F21V 23/006* (2013.01); *F21V 23/06* (2013.01); *H05B 45/357* (2020.01); *F21V 23/009* (2013.01); *F21Y 2103/10* (2016.08); *F21Y 2115/10* (2016.08)

(58) Field of Classification Search
CPC ..... F21K 9/278; F21K 9/275; H05B 45/30; H05B 45/357; H05B 45/3578; F21V 23/006
See application file for complete search history.

(56) References Cited

U.S. PATENT DOCUMENTS

| | | | | |
|---|---|---|---|---|
| 6,016,038 | A * | 1/2000 | Mueller | H05B 45/46 315/291 |
| 9,574,760 | B1 * | 2/2017 | Olsson | H05B 45/56 |
| 2010/0201269 | A1 * | 8/2010 | Tzou | F21K 9/278 315/51 |
| 2016/0109109 | A1 * | 4/2016 | Yingchun | F21K 9/278 362/218 |
| 2016/0186969 | A1 * | 6/2016 | Zhao | H05B 45/395 362/221 |
| 2018/0224074 | A1 * | 8/2018 | Xiong | H05B 45/00 |
| 2020/0271279 | A1 * | 8/2020 | Xiong | F21V 3/061 |

* cited by examiner

*Primary Examiner* — Alan B Cariaso
(74) *Attorney, Agent, or Firm* — Winston Hsu

(57) ABSTRACT

An LED tube with built-in driving power module is provided. Each of two ends of the LED tube has a conductive component electrically connected to mains supply. The conductive component at least includes a conductive pin assembly and a sleeve member for disposing the conductive pin assembly. The driving power module is formed by circuit boards, and the circuit boards are disposed in the sleeve member. Each of the circuit boards at least includes a functional operation unit, and the circuit boards are in series connection via one or more electrical connection members. The capacity space at both ends of the sleeve of LED tube is used to concentrate each circuit board in order to make full use of the capacity space. Meanwhile, the larger sleeve mold structure is avoided to cause the change of product appearance and increase the project development cost.

4 Claims, 6 Drawing Sheets

LED TUBE WITH BUILT-IN DRIVING POWER MODULE

BACKGROUND OF THE INVENTION

1. Field of the Invention

The present invention relates to an LED tube, in particular to a LED tube with built-in driving power module.

2. Description of the Prior Art

In recent years, with the trend of energy saving and carbon reduction, LED light source is widely used in different application markets. Among them, LED lighting provides innovative lighting devices to effectively reduce energy consumption, which will be widely used in areas where electricity is scarce, and will be widely used in the global market.

Existing fluorescent lamp tube is mated with a lamp base. If the fluorescent lamp tube is replaced by an LED tube without changing the base, different circuit modules, such as the filtering circuit module and the anti-leakage detection circuit module are added to the LED tube. When the LED is to provide complex functions, more circuit modules are to be provided on the LED tube, thereby increasing the space for installing the circuit modules on the circuit board. As a result, the size of the circuit board has to be increase. However, since the sleeve at two ends of an existing LED tube has a fixed size, when the size of the circuit board increases, the sleeve has to be redesigned and produced to have a certain size corresponding to the circuit board. Consequently, the overall appearance of the LED tube may be affected. Moreover, since sleeve in different sizes are to be produced, thereby increasing the costs for the component development.

Therefore, how to address the issues is to be considered.

SUMMARY OF THE INVENTION

In view of these, in one embodiment, a LED tube with built-in driving power module is provided. Each of two ends of the LED tube has a conductive component electrically connected to mains supply. The conductive component at least comprises a conductive pin assembly and a sleeve member for disposing the conductive pin assembly. The driving power module is formed by a plurality of circuit boards, and the circuit boards are disposed in the sleeve member. Each of the circuit boards at least comprises a functional operation unit, and the circuit boards are in series connection via at least one electrical connection member.

In some embodiments, each of the circuit boards comprises at least connection port, and the connection ports of the circuit boards are in series connection via the at least one electrical connection member.

In some embodiments, the at least one electrical connection member is a flexible printed circuit board, a wire, an insertion pin, or a golden finger.

In some embodiments, the functional operation unit is a rectifier, a filtering circuit module, an anti-leakage detection circuit module, a DC-DC buck constant current circuit module, or a buck-boost constant current circuit module.

In some embodiments, the sleeve member has a receiving space for receiving the circuit boards in series connection via the at least one electrical connection member.

Based on the above, according to one or more embodiments, the driving power module has following features.

The driving power module formed by several circuit boards is disposed in the sleeve member, each of the circuit board comprises at least one functional operation unit, and the circuit boards are in series connection via at least one electrical connection member. The receiving spaces of the sleeve members at two ends of the LED tube are properly utilized for receiving the circuit boards, thereby a proper utilization for the receiving spaces of the sleeve member being achieved. Moreover, additional larger-sized sleeve mold and component production can be omitted, thereby preventing the appearance of the product from being changed and preventing the development cost for the components of product from increasing.

These and other objectives of the present invention will no doubt become obvious to those of ordinary skill in the art after reading the following detailed description of the preferred embodiment that is illustrated in the various figures and drawings.

DETAILED DESCRIPTION

The detailed description of the technical content, structural features, and the objects and effects of the technical solutions will be described in detail below with reference to the specific embodiments and the accompanying drawings.

Figure 1:
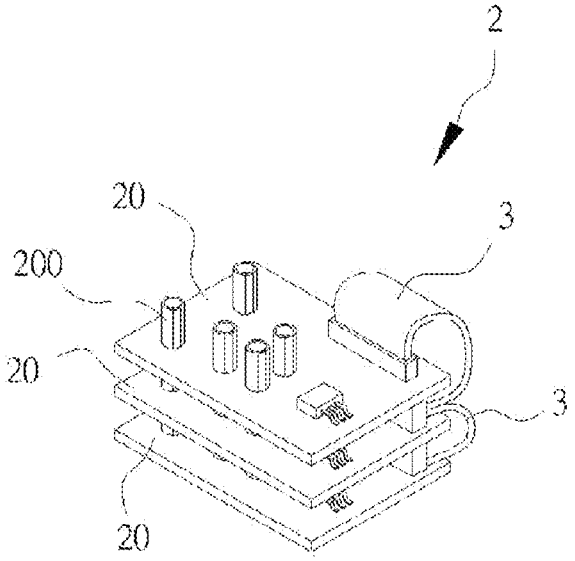
FIG. 1 illustrates a perspective view of a driving power module in an LED tube according to an exemplary embodiment of the present invention.
Figure 2:
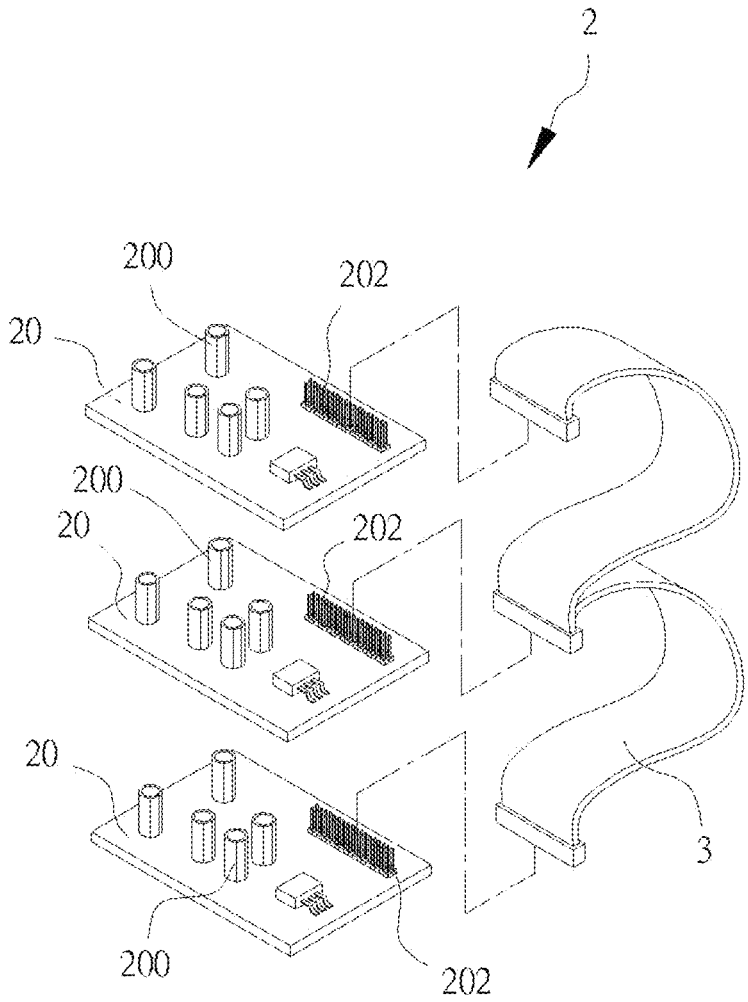
FIG. 2 illustrates an exploded view of the driving power module of the exemplary embodiment.

Please refer to FIGS. 1 and 2, respectively illustrate a perspective view and an exploded view of an LED tube with built-in driving power module according to an exemplary embodiment of the present invention. An LED tube with built-in driving power module 1 is provided. Each of two ends of the LED tube 1 has a conductive component 10 electrically connected to mains supply. The conductive component 10 at least comprises a conductive pin assembly 100 and a sleeve member 102 for disposing the conductive pin assembly 100. The sleeve member 102 has a receiving space 1020. The driving power module is formed by a plurality of circuit boards 20 in a stacking arrangement and disposed in the receiving space 1020 of the sleeve member 102. Each of the circuit boards 20 at least comprises a functional operation unit 200 (the functional operation unit 200 may be a rectifier, a filtering circuit module, an anti-leakage detection circuit module, a DC-DC buck constant current circuit module, or a buck-boost constant current circuit module). The circuit boards 20 are in series connection via at least one electrical connection member 3 (the electrical connection member 3 may be a flexible printed circuit board, a wire, an insertion pin, or a gold finger). The circuit boards 20 in series connection via the electrical connection member 3 are assembled in the sleeve member 102 with a general specification.

In some embodiments, each of the circuit boards 20 comprises at least one connection port 202, and the connection ports 202 of the circuit boards 20 are in series connection via the electrical connection member 3.

Figure 3:
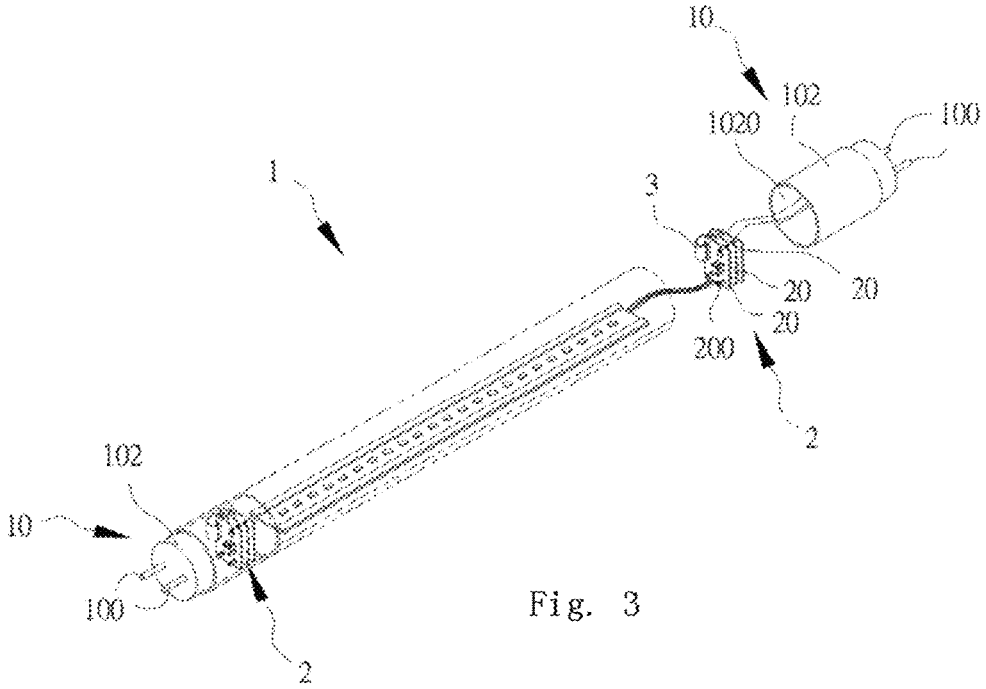
FIG. 3 illustrates a perspective view showing that the driving power module is installed in the LED tube.

Please also refer to FIG. 3. FIG. 3 illustrates a perspective view showing that the driving power module is installed in the LED tube. As mentioned, the circuit boards 20 are respectively comprises functional operation units 200 including the rectifier, the filtering circuit module, the anti-leakage detection circuit module, the DC-DC buck constant current circuit module, or the buck-boost constant current circuit module. In order to allow the functions of each of the circuit boards 20 can be operated, the electrical connection member 3 is applied to connect the connection ports 202 on the circuit boards 20. In this embodiment, the electrical connection member 3, as an example, is a flexible printed circuit board, and the number of the circuit boards 20, as an example, is three. The circuit boards 20 may be provided with the rectifier, the filtering circuit module, the anti-leakage detection circuit module, the DC-DC buck constant current circuit module, or the buck-boost constant current circuit module as the functional operation units 200. In order to allow the operations of the circuit boards 20, flexible printed circuit boards are connected to the connection ports 202 of the circuit boards 20. Next, the circuit boards 20 which are connected in series are received in the receiving space 1020 of a sleeve member 102 having a general specification. Then, the sleeve members 102 are respectively assembled to the two ends of the LED tube 1. Accordingly, the driving power module 2 formed by several circuit boards 20 can be disposed in the sleeve member 102, each of the circuit boards 20 at least comprises one functional operation unit 200, and the circuit boards 20 are in series connection via at least one electrical connection member 3. Hence, the receiving spaces 1020 of the sleeve members 102 at the two ends of the LED tube 1 can be utilized for receiving the circuit boards 20, thereby a proper utilization for the receiving spaces 1020 of the sleeve member 102 being achieved. Moreover, additional larger-sized sleeve mold and component production can be omitted, thereby preventing the appearance of the product from being changed and preventing the development cost for the components of product from increasing.

Figure 4:
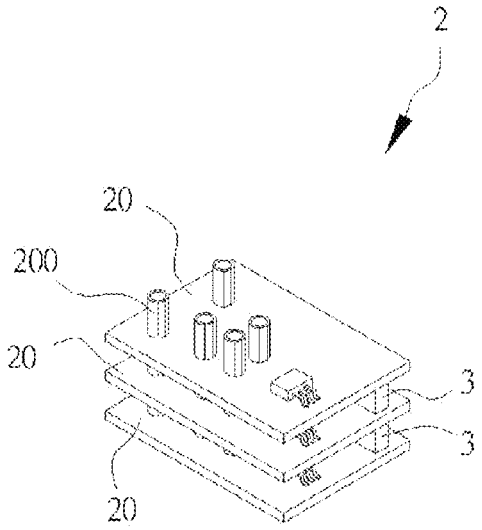
FIG. 4 illustrates a perspective view of the driving power module in another LED tube of the exemplary embodiment.
Figure 5:
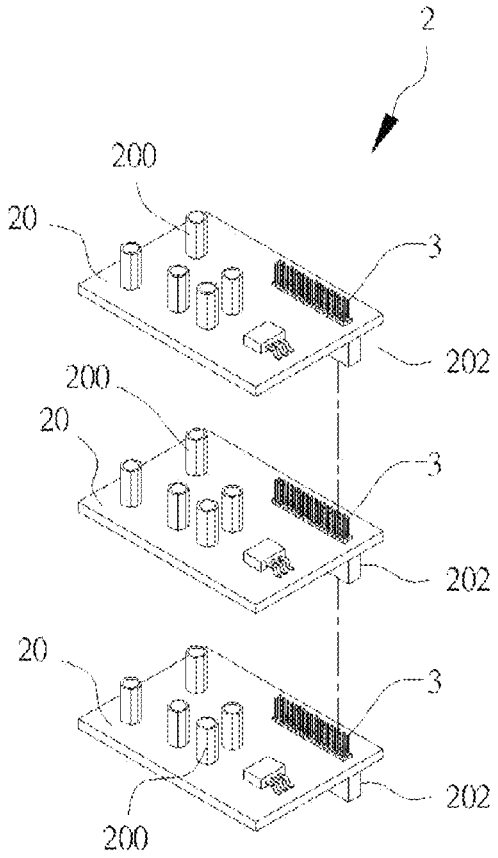
FIG. 5 illustrates an exploded view of the driving power module according another exemplary embodiment of the present invention.
Figure 6:
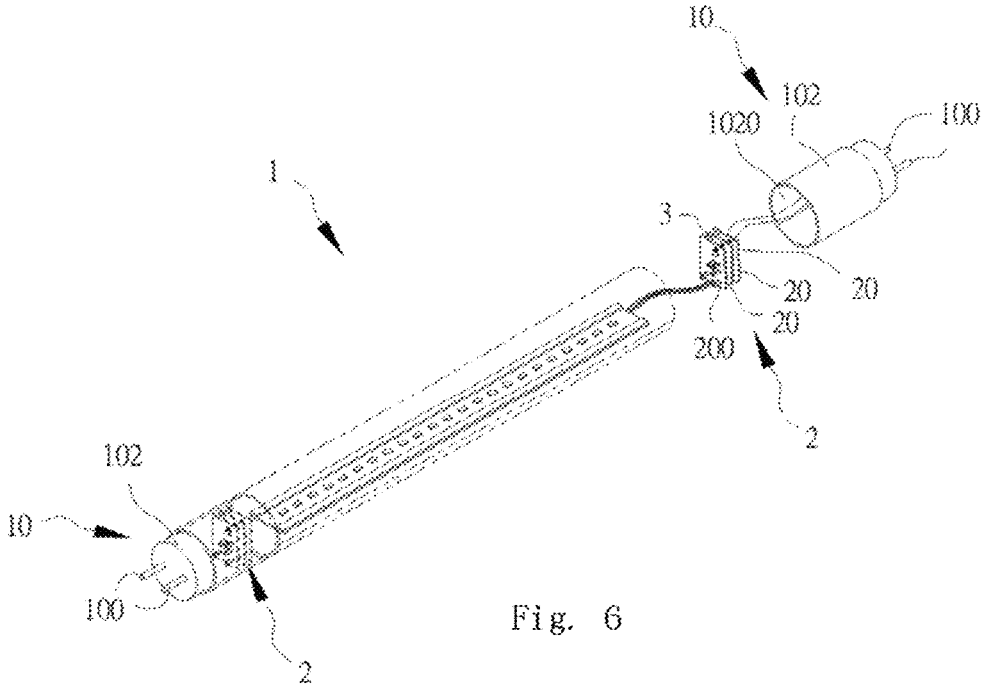
FIG. 6 illustrates a perspective view showing that the driving power module of another exemplary embodiment is installed in the LED tube.

Please refer to FIGS. 4 to 6. FIG. 4 illustrates a perspective view of the driving power module in another LED tube of the exemplary embodiment. FIG. 5 illustrates an exploded view of the driving power module according another exemplary embodiment of the present invention. FIG. 6 illustrates a perspective view showing that the driving power module of another exemplary embodiment is installed in the LED tube. As shown in FIGS. 4 to 6, the circuit boards 20 are respectively comprises functional operation units 200 including a rectifier, a filtering circuit module, an anti-leakage detection circuit module, the DC-DC buck constant current circuit module, or a buck-boost constant current circuit module. The electrical connection member 3 is applied to connect to the connection ports 202 on the circuit boards 20. In this embodiment, the electrical connection member 3, as an example, is an insertion pin, and the number of the circuit boards 20, as an example, is three. The circuit boards 20 may be provided with the rectifier, the filtering circuit module, the anti-leakage detection circuit module, the DC-DC buck constant current circuit module, or the buck-boost constant current circuit module as the functional operation units 200. In order to allow the operations of the circuit boards 20, the insertion pins are connected to the connection ports 202 of the circuit boards 20. Next, the circuit boards 20 which are connected in series are received in the receiving space 1020 of a sleeve member 102 having a general specification. Then, the sleeve members 102 are respectively assembled to the two ends of the LED tube 1.

Accordingly, the driving power module 2 formed by several circuit boards 20 can be disposed in the sleeve member 102, each of the circuit boards 20 at least comprises one functional operation unit 200, and the circuit boards 20 are in series connection via at least one electrical connection member 3. Hence, the receiving spaces 1020 of the sleeve members 102 at the two ends of the LED tube 1 can be utilized for receiving the circuit boards 20, thereby a proper utilization for the receiving spaces 1020 of the sleeve member 102 being achieved. Moreover, additional larger-sized sleeve mold and component production can be omitted, thereby preventing the appearance of the product from being changed and preventing the development cost for the components of product from increasing.

With the connection ports 202 formed on a top surface of the circuit boards 20 and the electrical connection members 3 formed on a bottom surface of the circuit board 20, when the connection ports 202 connect with the electrical connection members 3, the circuit boards 20 are easily and compactly disposed in an stacking arrangement and in series connection.

Although particular embodiments of the invention have been described in detail for purposes of illustration, various modifications and enhancements may be made without departing from the spirit and scope of the invention. Accordingly, the invention is not to be limited except as by the appended claims.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An LED tube with built-in driving power module, wherein each of two ends of the LED tube comprises:

a conductive component electrically connected to mains supply and comprising a conductive pin assembly and a sleeve member for disposing the conductive pin assembly;

a driving power module being formed by a plurality of circuit boards disposed in the sleeve member and being in series connection; each of the circuit boards comprising a functional operation unit;

wherein the sleeve member has a receiving space for receiving the circuit boards in series connection;

wherein each of the circuit boards comprises at least connection port formed on a top surface of the circuit board and at least one electrical connection member formed on a bottom surface of the circuit board; and wherein the circuit boards are in an stacking arrangement and are in series connection via the connection ports being connected with the electrical connection members.

2. The LED tube with built-in driving power module according to claim 1, wherein the functional operation unit is a rectifier, a filtering circuit module, an anti-leakage detection circuit module, a DC-DC buck constant current circuit module, or a buck-boost constant current circuit module.

3. An LED tube with built-in driving power module, wherein each of two ends of the LED tube comprises:

a conductive component electrically connected to mains supply and comprising a conductive pin assembly and a sleeve member for disposing the conductive pin assembly;

a driving power module being formed by a plurality of circuit boards disposed in the sleeve member and being in series connection via at least one electrical connection member; each of the circuit boards comprising a functional operation unit;

wherein the sleeve member has a receiving space for receiving the circuit boards in series connection;

wherein each of the circuit boards comprises at least connection port formed on a top surface of the circuit board, and an electrical connection member being a flexible wire;

wherein the circuit boards are in an stacking arrangement and are in series connection via the connection ports being connected with the at least one electrical connection member.

4. The LED tube with built-in driving power module according to claim 3, wherein the functional operation unit is a rectifier, a filtering circuit module, an anti-leakage detection circuit module, a DC-DC buck constant current circuit module, or a buck-boost constant current circuit module.

* * * * *